US011851806B2

(12) United States Patent
Leibman et al.

(10) Patent No.: US 11,851,806 B2
(45) Date of Patent: Dec. 26, 2023

(54) WIRELESSLY POWERED ADDITIVE DISPENSING ASSEMBLY AND LAUNDRY APPLIANCE

(71) Applicant: Haier US Appliance Solutions, Inc., Wilmington, DE (US)

(72) Inventors: Alexander B. Leibman, Prospect, KY (US); Alexis C. Taylor, Louisville, KY (US); Jonah Connelly, Louisville, KY (US); Nemetalla Salameh, Louisville, KY (US); Khalid Mashal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 644 days.

(21) Appl. No.: 17/091,235

(22) Filed: Nov. 6, 2020

(65) Prior Publication Data

US 2022/0145522 A1 May 12, 2022

(51) Int. Cl.

| | |
|---|---|
| ***D06F 58/20*** | (2006.01) |
| ***D06F 58/04*** | (2006.01) |
| ***D06F 34/05*** | (2020.01) |
| ***D06F 34/10*** | (2020.01) |
| ***D06F 103/40*** | (2020.01) |
| ***D06F 105/38*** | (2020.01) |

(52) U.S. Cl.

CPC ..... *D06F 58/203* (2013.01); *D06F 34/05* (2020.02); *D06F 34/10* (2020.02); *D06F 58/04* (2013.01); *D06F 2103/40* (2020.02); *D06F 2105/38* (2020.02)

(58) Field of Classification Search

CPC ..... D06F 58/203; D06F 58/04; D06F 34/05; D06F 34/10; D06F 2105/38; D06F 2103/40

USPC ..... 34/389, 595–610

See application file for complete search history.

(56) References Cited

U.S. PATENT DOCUMENTS

| | | | | |
|---|---|---|---|---|
| 8,104,191 | B2 * | 1/2012 | Ricklefs | D06F 58/203 68/5 R |
| 8,106,539 | B2 | 1/2012 | Fiorello | |
| 8,336,227 | B2 * | 12/2012 | Bae | D06F 58/203 68/17 R |

(Continued)

FOREIGN PATENT DOCUMENTS

| | | | | |
|---|---|---|---|---|
| BR | 102014013346 | A2 * | 4/2016 | D06F 39/022 |
| CA | 2852304 | A1 * | 11/2014 | D06F 39/022 |

(Continued)

*Primary Examiner* — Stephen M Gravini

(74) *Attorney, Agent, or Firm* — Dority & Manning, P.A.

(57) ABSTRACT

A laundry or dryer appliance may include a cabinet, a drum, a transmitter power coil, and an additive dispensing assembly. The transmitter power coil may be mounted to the cabinet proximal to the door. The additive dispensing assembly may include a fluid pump, a receiver power coil, and a dispenser nozzle. The fluid pump may motivate a volume of a liquid additive therefrom for an additive mist to the drum. The receiver power coil may be in selective wireless communication with the transmitter power coil to receive an electromagnetic field therefrom. The receiver power coil may be operably coupled to the fluid pump. The dispenser nozzle may be directed toward the drum downstream from the fluid pump to guide the volume of the liquid additive into the space defined by the drum.

20 Claims, 11 Drawing Sheets

(56) References Cited

U.S. PATENT DOCUMENTS

| | | | | |
|---|---|---|---|---|
| 9,140,497 | B2 * | 9/2015 | Al-Shahrani | F26B 25/18 |
| 9,194,625 | B2 * | 11/2015 | Herman | F26B 11/0477 |
| 9,267,229 | B2 * | 2/2016 | Oh | D06F 58/203 |
| 9,689,105 | B2 * | 6/2017 | Martinez Villarreal | D06F 39/028 |
| 9,708,751 | B2 | 7/2017 | Bae | |
| 9,951,460 | B2 * | 4/2018 | Boulduan | D06F 39/02 |
| 10,392,740 | B2 | 8/2019 | Chernetski et al. | |
| 10,584,440 | B2 * | 3/2020 | Kim | D06F 58/206 |
| 2011/0162224 | A1 | 7/2011 | Bae | |
| 2014/0373284 | A1 * | 12/2014 | Leibman | D06F 39/022 68/17 R |
| 2015/0192030 | A1 * | 7/2015 | Rubinshtein | F01D 1/20 290/52 |
| 2017/0338860 | A1 | 11/2017 | Mingjie | |
| 2022/0145522 | A1 * | 5/2022 | Leibman | D06F 34/05 |
| 2022/0349110 | A1 * | 11/2022 | Kim | D06F 33/38 |

FOREIGN PATENT DOCUMENTS

| | | | | | |
|---|---|---|---|---|---|
| CN | 103166326 | A | | 6/2013 | |
| CN | 116157567 | A | * | 5/2023 | D06F 39/022 |
| DE | 10319532 | B4 | | 12/2017 | |
| DE | 102018006154 | A1 | | 2/2020 | |
| EP | 3502336 | A1 | | 6/2019 | |
| JP | 2001033136 | A | | 2/2001 | |
| WO | WO2013087774 | A1 | | 6/2013 | |
| WO | WO2019223849 | A1 | | 11/2019 | |
| WO | WO-2022053053 | A1 | * | 3/2022 | D06F 39/022 |

* cited by examiner

WIRELESSLY POWERED ADDITIVE DISPENSING ASSEMBLY AND LAUNDRY APPLIANCE

FIELD OF THE INVENTION

The present subject matter relates generally to laundry appliances, such as dryer appliances, and more particularly to wirelessly powered additive dispensers for laundry appliances.

BACKGROUND OF THE INVENTION

Laundry appliances, such as dryer appliances, generally include a cabinet with a drum mounted therein. In some appliances, a motor rotates the drum during operation of the thereof (e.g., to tumble articles located within a chamber defined by the drum). Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

In some instances, it may be desirable to provide certain objects or fluids for the treatment of articles within an appliance. For instance, dryer sheets are commonly placed within the drum of a dryer appliance to affect the smell of the fabrics or clothes being treated (e.g., tumbled or dried) in a specific laundry load. In other instances, a wrinkle release fluid (e.g., fluids comprising fabric relaxer, fabric softener, isopropyl alcohol, vinegar, etc.) may be applied to sprayed on articles by a user before or after the articles are treated by the dryer appliance. In still other instances a UV fabric protector (e.g., fluids comprising titanium oxide, bemotrizinol, etc.) to absorb or repel ultraviolet light emissions may be sprayed on articles by a user before or after the articles are treated by the dryer appliance. However, difficulties exist with such approaches. Specifically, a user must generally remember to supply a specific object or fluid to each individual drying load. Moreover, in many cases a user must estimate or guess how much of the specific object or fluid is appropriate for an individual load. Although some existing dryer appliances provide for automatically (e.g., without direct user input) supplying steam to individual dryer loads, existing dryer appliances are generally unable to automatically supply specific additives to articles therein. Moreover, providing power or control signals to any such dispenser would present a challenge Accordingly, a laundry appliance having an additive dispensing assembly for delivering certain additives affecting the smell or performance of fabrics would be desirable. More particularly, a laundry appliance having an additive dispensing assembly that provides a suitable additive volume load across a range of applications would be desirable, especially if power could be supplied to one or more areas without requiring a direct wired connection.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, a transmitter power coil, and an additive dispensing assembly. The drum may be rotatably mounted within the cabinet. The drum may define a space for the receipt of clothes for drying. The transmitter power coil may be mounted to the cabinet apart from the drum. The additive dispensing assembly may be held apart from the transmitter power coil and configured to provide an additive mist to the drum. The additive dispensing assembly may include a fluid pump a receiver power coil, and a dispenser nozzle. The fluid pump may motivate a volume of a liquid additive therefrom for the additive mist. The receiver power coil may be in selective wireless communication with the transmitter power coil to receive an electromagnetic field therefrom. The receiver power coil may be operably coupled to the fluid pump. The dispenser nozzle may be directed toward the drum downstream from the fluid pump to guide the volume of the liquid additive into the space defined by the drum.

In another exemplary aspect of the present disclosure, a laundry appliance is provided. The laundry appliance may include a cabinet, a drum, a door, a transmitter power coil, and an additive dispensing assembly. The drum may be rotatably mounted within the cabinet. The drum may define a space for the receipt of clothes. The door may be movably mounted to the cabinet to selectively restrict access to the drum. The transmitter power coil may be mounted to the cabinet proximal to the door. The additive dispensing assembly may be held on the door. The additive dispensing assembly may be electrically isolated and configured to provide an additive mist to the drum. The additive dispensing assembly may include a fluid pump, a receiver power coil, and a dispenser nozzle. The fluid pump may motivate a volume of a liquid additive therefrom for the additive mist. The receiver power coil may be in selective wireless communication with the transmitter power coil to receive an electromagnetic field therefrom. The receiver power coil may be operably coupled to the fluid pump. The dispenser nozzle may be directed toward the drum downstream from the fluid pump to guide the volume of the liquid additive into the space defined by the drum.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
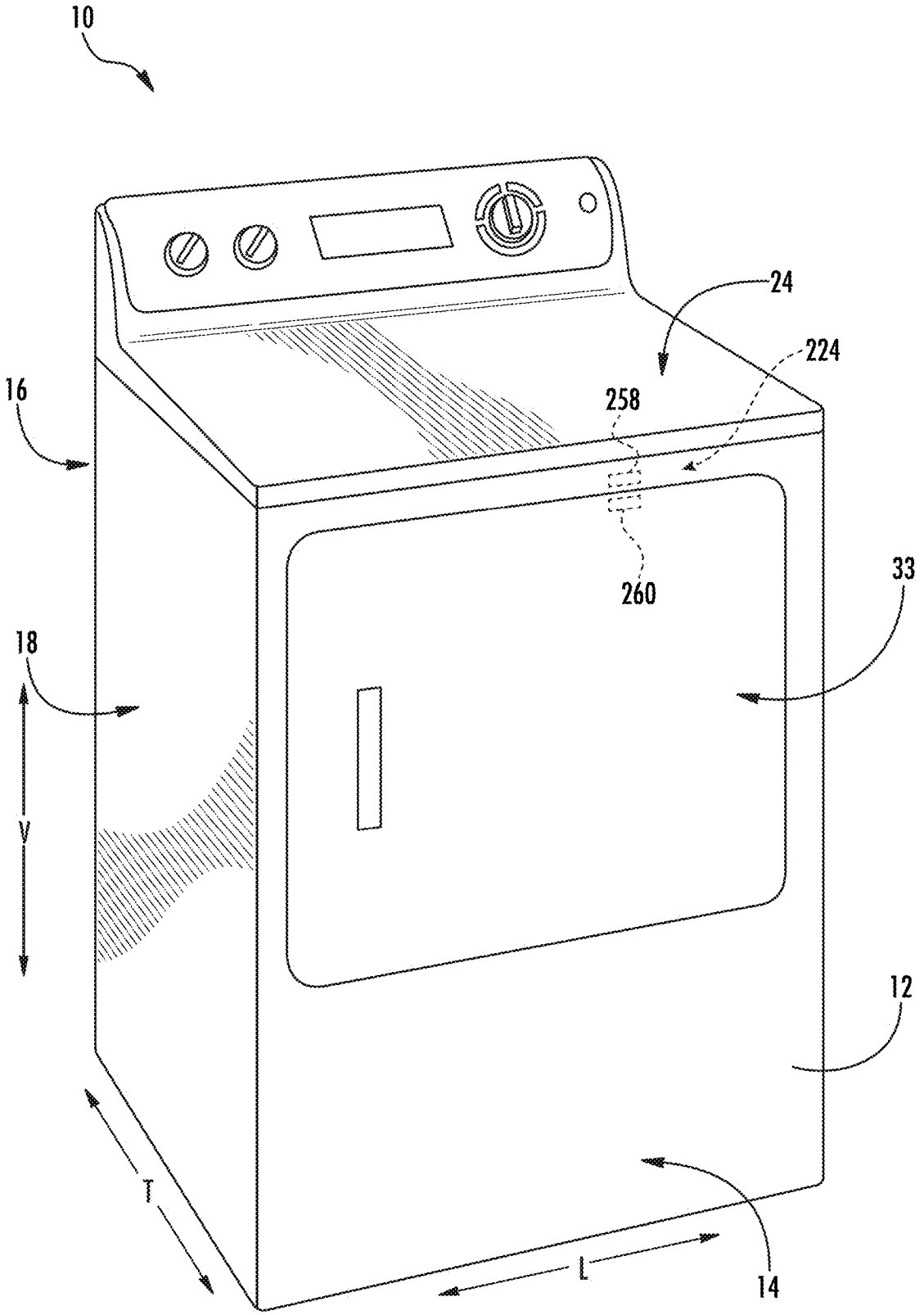
FIG. 1 provides a perspective view of a laundry appliance provided as a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "clothing" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

Figure 2:
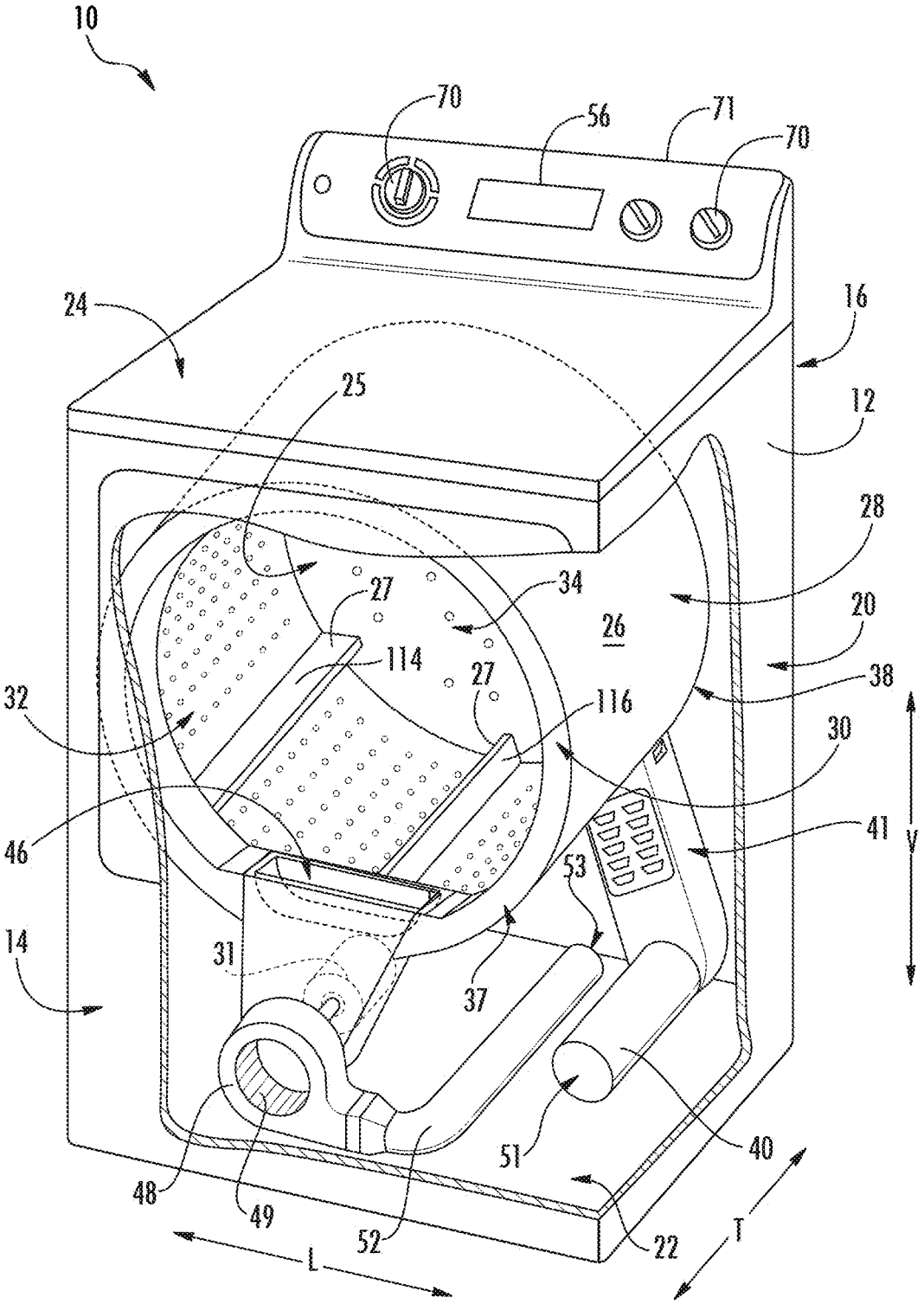
FIG. 2 provides a perspective view of the exemplary dryer appliance of FIG. 1 with portions of a cabinet of the dryer appliance removed to reveal certain components of the dryer appliance.

Turning now to the figures, FIG. 1 provides a laundry appliance (e.g., dryer appliance 10) according to exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other laundry appliances, such as a washing machine appliance (e.g., front-load washing machine) or other dryer appliances having different appearances and different features, may also be used with the present subject matter as well.

Cabinet 12 includes a front panel 14, a rear panel 16, a pair of side panels 18 and 20 spaced apart from each other by front and rear panels 14 and 16, a bottom panel 22, and a top cover 24. As shown, cabinet 12 may define an opening (e.g., at or through front panel 14) which permits access to the interior of cabinet 12. Within cabinet 12 is a drum or container 26 mounted for rotation about a substantially horizontal axis. Drum 26 defines a chamber 25 for receipt of articles of clothing (e.g., for tumbling or drying) through the opening of front panel 14. Drum 26 extends between a front portion 37 and a back portion 38. Drum 26 also includes a back or rear wall 34 (e.g., at back portion 38 of drum 26). A supply duct 41 is mounted to rear wall 34 and receives heated air that has been heated by a heating assembly or system 40.

A motor 31 is provided in some embodiments to rotate drum 26 about the horizontal axis (e.g., via a pulley and a belt—not pictured). Drum 26 is generally cylindrical in shape, having an outer cylindrical wall 28 and a front flange or wall 30 that defines an opening 32 of drum 26 (e.g., at front portion 37 of drum 26) for loading and unloading of articles into and out of chamber 25 of drum 26. A plurality of lifters or baffles (e.g., baffles 27) are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Motor 31 may also be in mechanical communication with an air handler 48 such that motor 31 rotates a fan 49 (e.g., a centrifugal fan) of air handler 48. Air handler 48 is configured for drawing air through chamber 25 of drum 26 (e.g., in order to dry articles located therein). In alternative exemplary embodiments, dryer appliance 10 may include an additional motor (not shown) for rotating fan 49 of air handler 48 independently of drum 26.

Drum 26 is generally configured to receive heated air that has been heated by a heating assembly 40 (e.g., in order to dry damp articles disposed within chamber 25 of drum 26). For example, heating assembly 40 may include a heating element (not shown), such as a gas burner, an electrical resistance heating element, or heat pump, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture (e.g., from damp clothing disposed within chamber 25). In turn, air handler 48 draws moisture saturated air through a screen filter (not shown) which traps lint particles. Such moisture statured air then enters an exit duct 46 and is passed through air handler 48 to an exhaust duct 52. From exhaust duct 52, such moisture statured air passes out of dryer appliance 10 through a vent 53 defined by cabinet 12. After the clothing articles have been dried, they may be removed from the drum 26 via opening 32. A door 33 mounted to cabinet 12 provides for closing or accessing drum 26 through opening 32.

One or more selector inputs 70, such as knobs, buttons, touchscreen interfaces, etc., may be provided or mounted on a cabinet backsplash 71 and is in operable communication (e.g., electrically coupled or coupled through a wireless network band) with a processing device or controller 56. Signals generated in controller 56 direct operation of motor 31 and heating assembly 40 in response to the position of selector knobs 70. Alternatively, a touch screen type interface may be provided. As used herein, "processing device" or "controller" may refer to one or more microprocessors, microcontroller, ASICS, or semiconductor devices and is not restricted necessarily to a single element. The controller 56 may be programmed to operate dryer appliance 10 by executing non-transitory instructions stored in memory. The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations.

Figure 3:
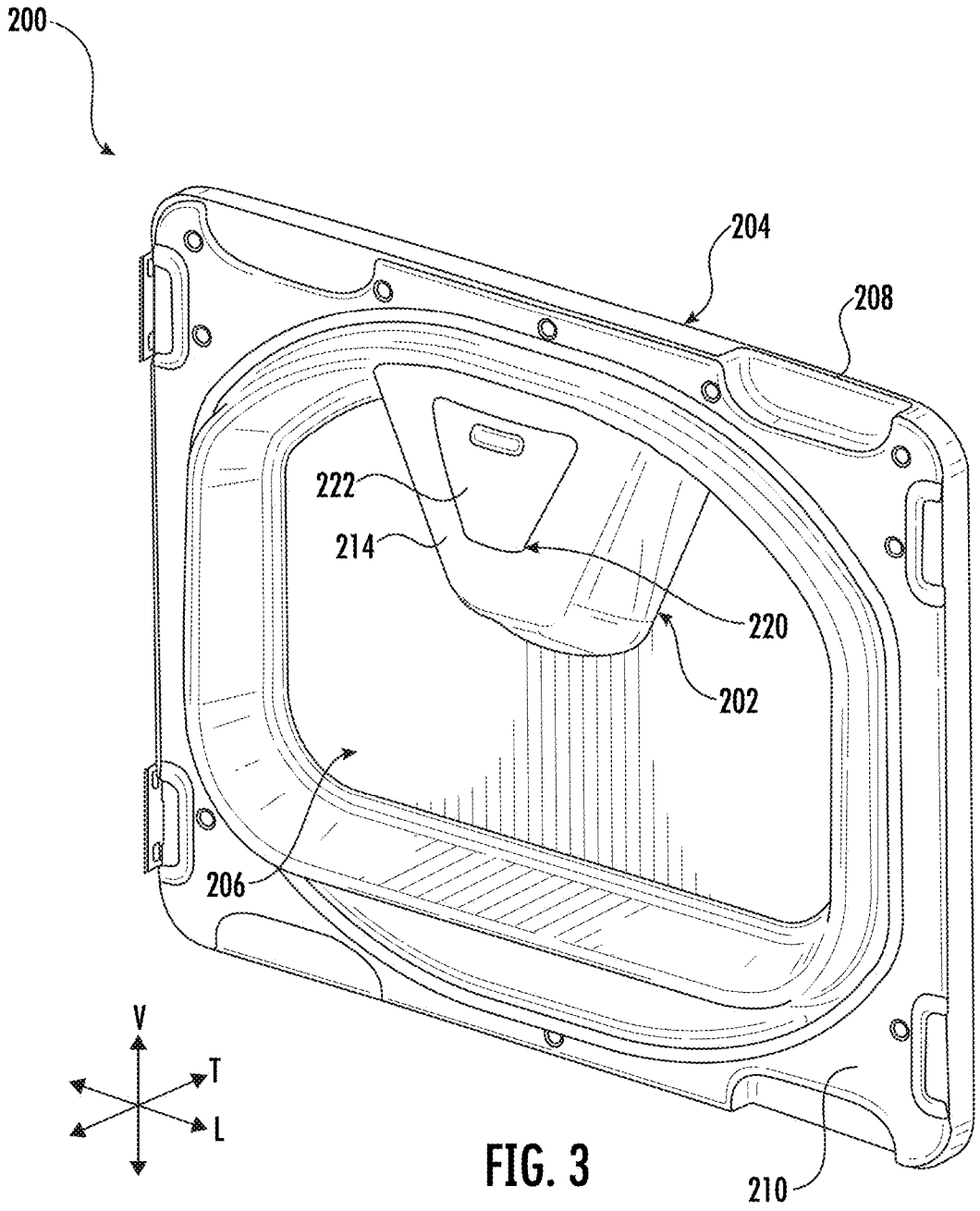
FIG. 3 provides a perspective view of a door, in isolation, of a laundry appliance according to exemplary embodiments of the present disclosure.
Figure 4:
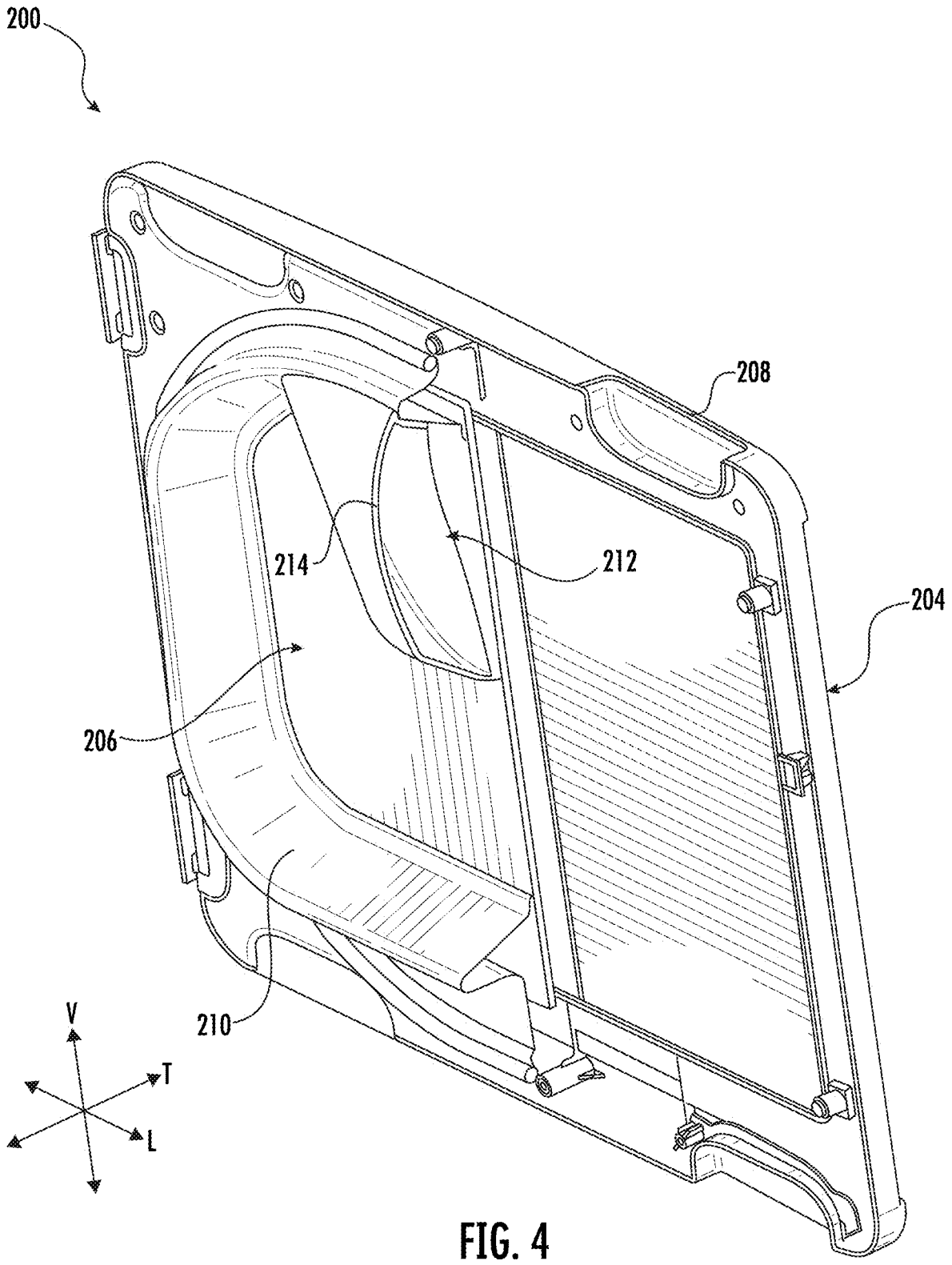
FIG. 4 provides a perspective of the exemplary door of FIG. 3 with various components removed to reveal certain portions of the door.
Figure 5:
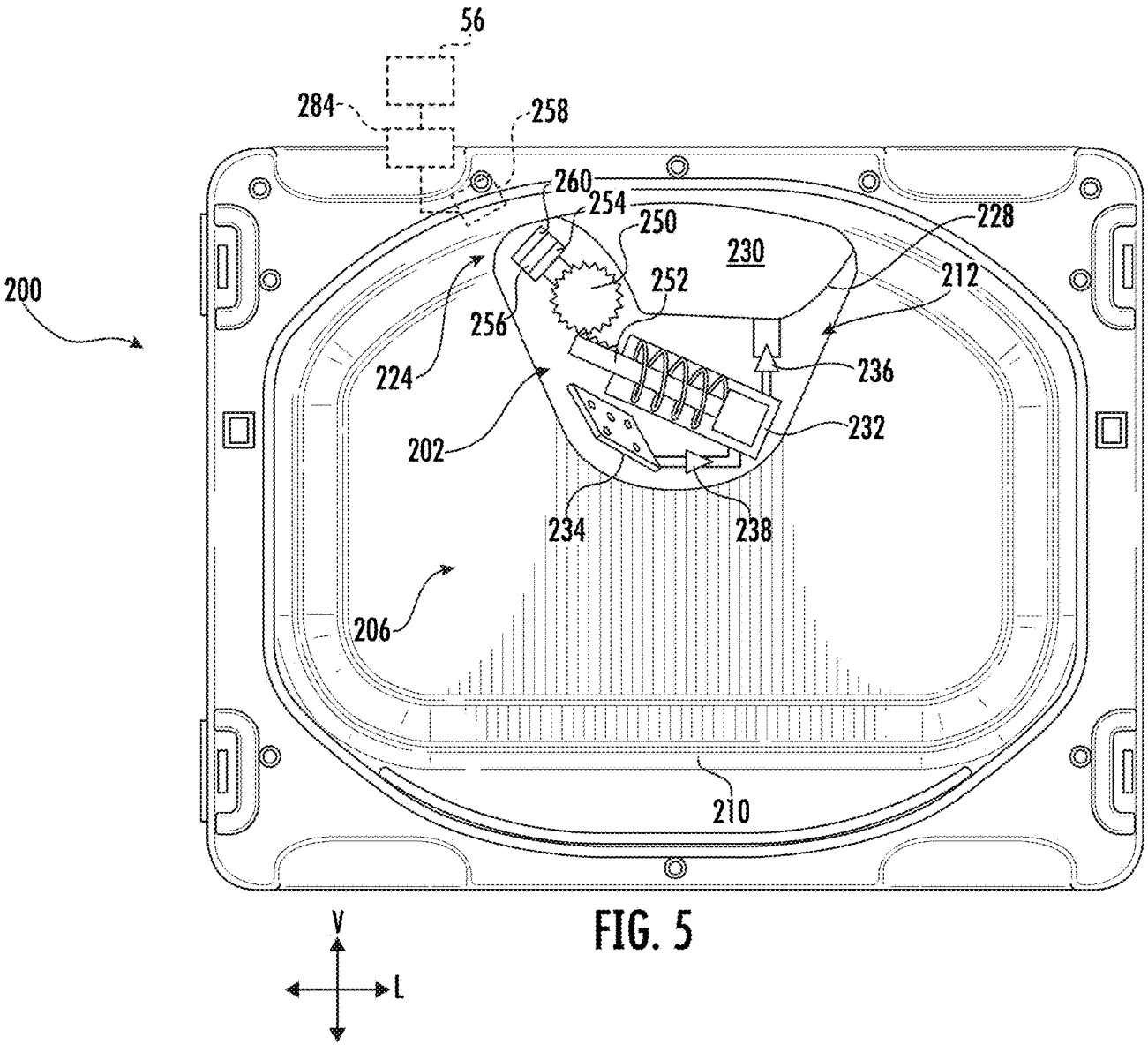
FIG. 5 provides a schematic rear elevation view of the exemplary door of FIG. 3.
Figure 6:
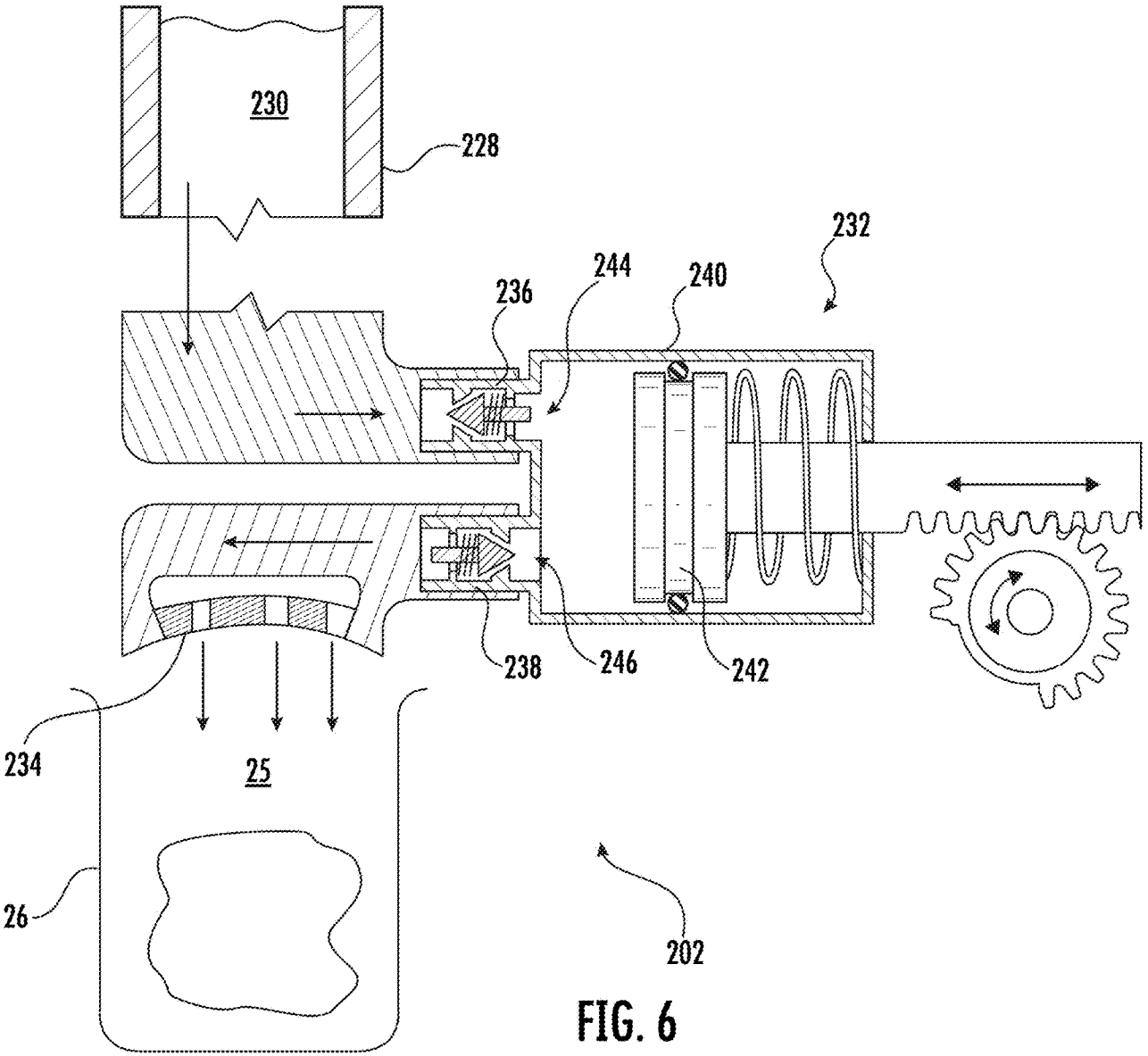
FIG. 6 provides a schematic view of the additive dispensing assembly of the exemplary door of FIG. 3.
Figure 7:
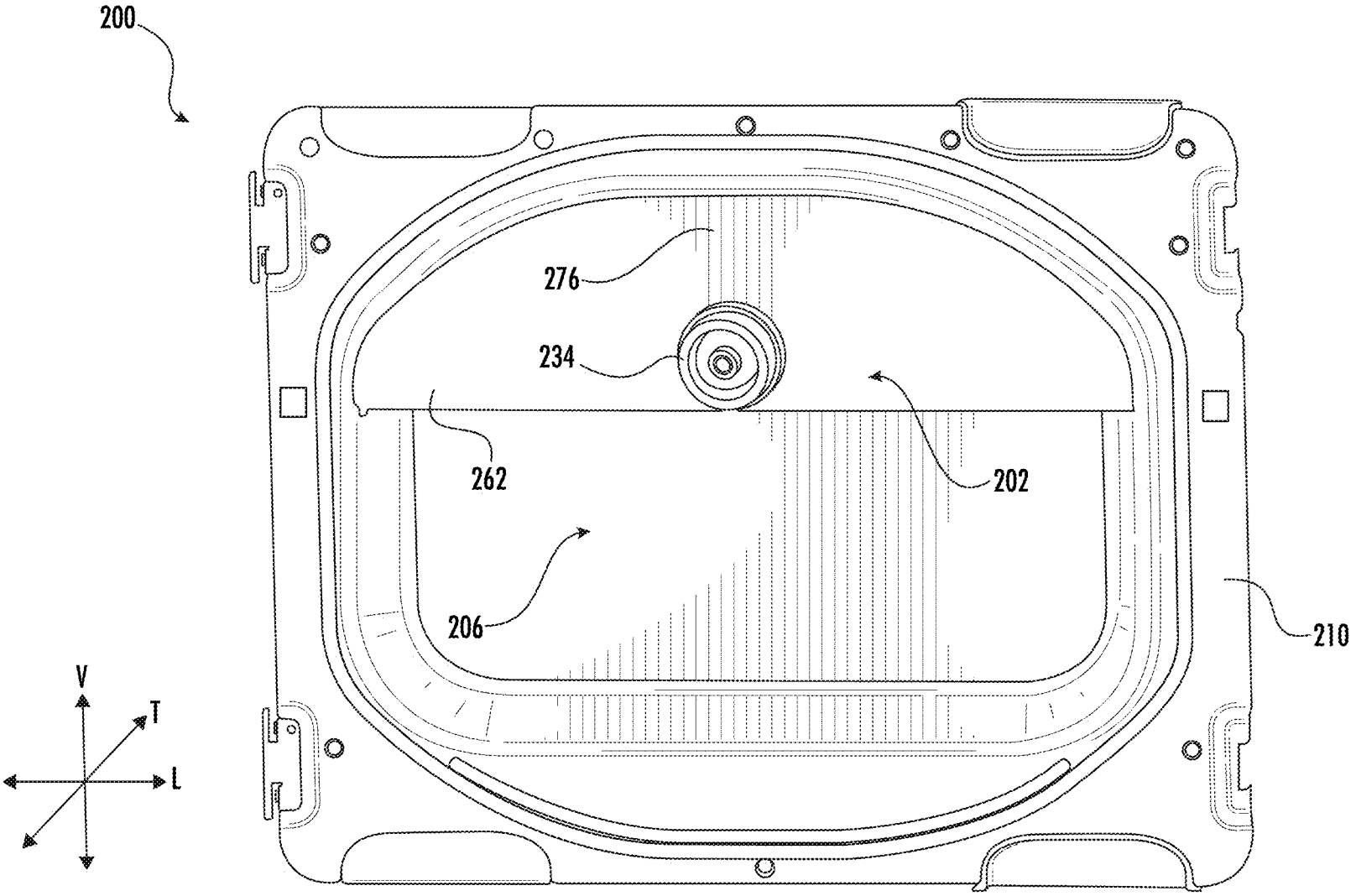
FIG. 7 provides a perspective view of a door, in isolation, of a laundry appliance according to exemplary embodiments of the present disclosure.

Referring now to FIGS. 3 through 6, a door 200 and additive dispensing assembly 202 are illustrated according to exemplary embodiments of the present disclosure. Specifically, FIGS. 3 through 5 provide various views of a door 200 (e.g., provided as or as part of door 33) to a laundry appliance (e.g., dryer appliance 10). FIGS. 5 and 6 illustrate portions of additive dispensing assembly 202 both within door 200 (FIG. 5) and in isolation (FIG. 6) for clarity. Although the discussion below refers to additive dispensing assembly 202, one skilled in the art will appreciate that the features and configurations described may be used for other additive dispensers in other dryer appliances as well. For example, additive dispensing assembly 202 may be positioned elsewhere within door 200; may have a different components or configurations; or may dispense water, detergent, or other additives. It is understood that other variations and modifications of the exemplary embodiments described below are possible, and such variations are contemplated as within the scope of the present subject matter.

As shown, door 200 generally includes an exterior surface 204 and an interior surface 206 spaced apart from each other along the transverse direction T (e.g., as defined when door 200 is in a closed position restricting access to drum 26, such as the position illustrated in FIG. 1). As is understood, when door 200 is rotatably or pivotably mounted on cabinet 12, exterior surface 204 is directed away from the drum 26 while interior surface 206 is directed toward drum 26. Thus, exterior surface 204 is distal to drum 26, and interior surface 206 is proximal to drum 26. In some such embodiments, at least a portion of exterior surface 204 is defined by an outer panel 208 (e.g., comprising an air-impermeable metal, glass, or polymer), and at least a portion of interior surface 206 is defined by an inner panel 210 (e.g., comprising an air-impermeable metal, glass, or polymer) that is joined to (e.g., separably as discrete elements or, alternatively, integrally as a unitary element with) the outer panel 208.

Between exterior surface 204 and interior surface 206, an internal cavity 212 is defined. For instance, a discrete assembly panel 214 may be attached to inner panel 210. Assembly panel 214 may form internal cavity 212 within itself or with at least a portion of inner panel 210. When assembled, assembly panel 214 may extend generally inward toward drum 26 (e.g., from a recessed or planar portion of inner panel 210), thereby forming an internally protruding swell of interior surface 206 within which internal cavity 212 is defined. An opening 220 defined through interior surface 206 (e.g., through assembly panel 214) may permit a user to selectively access internal cavity 212 when door 200 is in an open position (or otherwise not fully closed).

In certain embodiments, a movable or removable flap 222 is provided and selectively covers the opening 220 to internal cavity 212. For instance, as would be understood, flap 222 can be moved (e.g., pivoted, slid, or detached from assembly panel 214) to an uncovered position apart from the opening 220. Thus, flap 222 can permit access to internal cavity 212 in the uncovered position. By contrast, in the covered position (e.g., shown in FIG. 3), flap 222 restricts access to internal cavity 212 such that a user may be unable to pass a hand or object through opening 220 to internal cavity 212.

As shown, an additive dispensing assembly 202 is held on door 200. For instance, at least a portion of additive dispensing assembly 202 may be mounted within internal cavity 212. As will be described in detail below, additive dispensing assembly 202 may include an additive tank 228, fluid pump 232, or dispenser nozzle 234 (e.g., in fluid communication with each other to selectively dispense an additive mist to drum 26).

In some embodiments, one or more portions of additive dispensing assembly 202 (e.g., additive tank 228 or fluid pump 232) are secured within internal cavity 212 via a plurality of mounting features or mechanical fasteners. Additionally or alternatively, adhesive(s), snap-fit mechanisms, interference-fit mechanisms, or any suitable combination thereof may secure one or more portions of additive dispensing assembly 202 to door 200. One skilled in the art will appreciate that additive dispensing assembly 202 may be mounted to door 200 using other mounting means according to alternative embodiments.

Generally, additive tank 228 is mounted upstream from dispenser nozzle 234 to retain a liquid additive (e.g., dryer additive or wash additive) that may be dispensed to drum 26 through dispenser nozzle 234. Thus, one or more suitable fluid conduits or pipes may extend from additive tank 228 to dispenser nozzle 234. In certain embodiments, additive tank 228 defines a tank volume 230 within internal cavity 212, and within which a liquid additive may be poured. For instance, tank volume 230 may be provided as an isolated (e.g., non-plumbed) volume. Thus, a user may directly supply an additive (e.g., liquid additive) to tank volume 230, which may then be used during operation of the respective appliance. Moreover, a user may directly refill the liquid additive by opening the door 200, opening the internal cavity 212 (e.g., by lifting flap 222), and accessing or removing additive tank 228 from internal cavity 212.

Generally, tank volume 230 may be sized to store sufficient amounts of liquid additives for multiple cycles in order to avoid requiring the user to add a measured quantity of liquid additive prior to each dryer cycle. Optionally, the liquid additive may include a perfume material to provide a desirable smell or scent to a dry load. Additionally or alternatively, the liquid additive may include a UV fabric protector (e.g., a fluid comprising titanium oxide, bemotrizinol, etc.) to absorb or repel ultraviolet light emissions. Also additionally or alternatively, the liquid additive may include a wrinkle release fluid (e.g., a fluid comprising fabric relaxer, fabric softener, isopropyl alcohol, vinegar, etc.) to reduce or prevent wrinkles from forming on articles within a dry load. Further additionally or alternatively, the liquid additive may include a medicinal liquid (e.g., antibacterial liquid, antiallergen, dermatitis-treatment liquid, burn-treatment liquid, insect repellant, topical cannabinoid, etc.). Moreover, it is noted that any other suitable liquid additive may be included.

As shown, fluid pump 232 is in fluid communication with additive tank 228. For instance, one or more suitable fluid conduits or pipes may extend from additive tank 228 to fluid pump 232 or, alternatively, from fluid pump 232 to additive tank 228.

In exemplary embodiments, fluid pump 232 is downstream from additive tank 228 to selectively motivate a volume (e.g., predetermined volume) of liquid additive from additive tank 228. In some such embodiments, a check valve or one-way valve (e.g., first one-way valve 236) is mounted in fluid communication between additive tank 228 and fluid pump 232. In other words, a first one-way valve 236 may be disposed along the fluid path or conduit extending from additive tank 228 to fluid pump 232. First one-way valve 236 may thus ensure a unidirectional flow of liquid additive downstream from additive tank 228 (e.g., according to gravity or negative pressure generated at fluid pump 232).

Generally, fluid pump 232 may be provided as any suitable powered pump (i.e., not manually operated) to selectively force or motivate liquid or liquid additive from additive tank 228 to dispenser nozzle 234. In exemplary embodiments, fluid pump 232 includes a reciprocating pump assembly. For instance, fluid pump 232 may include a fluid cylinder 240 and a reciprocating piston 242 slidably disposed within cylinder 240. As shown, cylinder 240 may define a separate cylinder inlet 244 and cylinder outlet 246 through which liquid or liquid additive can enter and exit cylinder 240, respectively (e.g., according to the position of reciprocating piston 242 within cylinder 240). A pump motor 248 may be connected to or in mechanical communication with reciprocating piston 242 to control the position or movement of reciprocating piston 242 relative to cylinder 240. As an example, pump motor 248 may include a pinion gear 250 in mechanical communication with a rack gear provided on the piston rod 252 of reciprocating piston 242.

In some embodiments, fluid pump 232 is powered (e.g., selectively) by a wireless power assembly 224. Specifically, wireless power assembly 224 may be in operable communication (e.g., electrical communication) with controller 56. In turn, controller 56 may selectively direct a voltage or signal to fluid pump 232 through wireless power assembly 224, as will be described in greater detail below.

Downstream from the fluid pump 232 and additive tank 228, dispenser nozzle 234 is mounted. Generally, dispenser nozzle 234 defines one or more output apertures for additive dispensing assembly 202 and is directed toward the drum 26 to guide or dispense a volume of the liquid additive into the space defined by the drum 26. In some embodiments, dispenser nozzle 234 is mounted proximal to or on interior surface 206. For instance, dispenser nozzle 234 may be mounted to assembly panel 214, as shown. Alternatively, dispenser nozzle 234 may be mounted apart from assembly panel 214 (e.g., rearward therefrom within internal cavity 212). In some such embodiments, one or more holes are defined through assembly panel 214 to permit the spray of liquid or liquid additive into the space defined by drum 26. Optionally, dispenser nozzle 234 may include or be provided as an atomizer nozzle. Fluid flowing through additive dispensing assembly 202 from additive tank 228 may thus be directed into drum 26 as an atomized misted flow of liquid or dryer additive.

In some embodiments, a check valve or one-way valve (e.g., second one-way valve 238) is mounted in fluid communication between fluid pump 232 and dispenser nozzle 234. In other words, a second one-way valve 238 may be disposed along the fluid path or conduit extending from fluid pump 232 to dispenser nozzle 234. Second one-way valve 238 may thus ensure a unidirectional flow of liquid additive from the fluid path downstream from fluid pump 232 (e.g., according to gravity or negative pressure generated at fluid pump 232).

Figure 8:
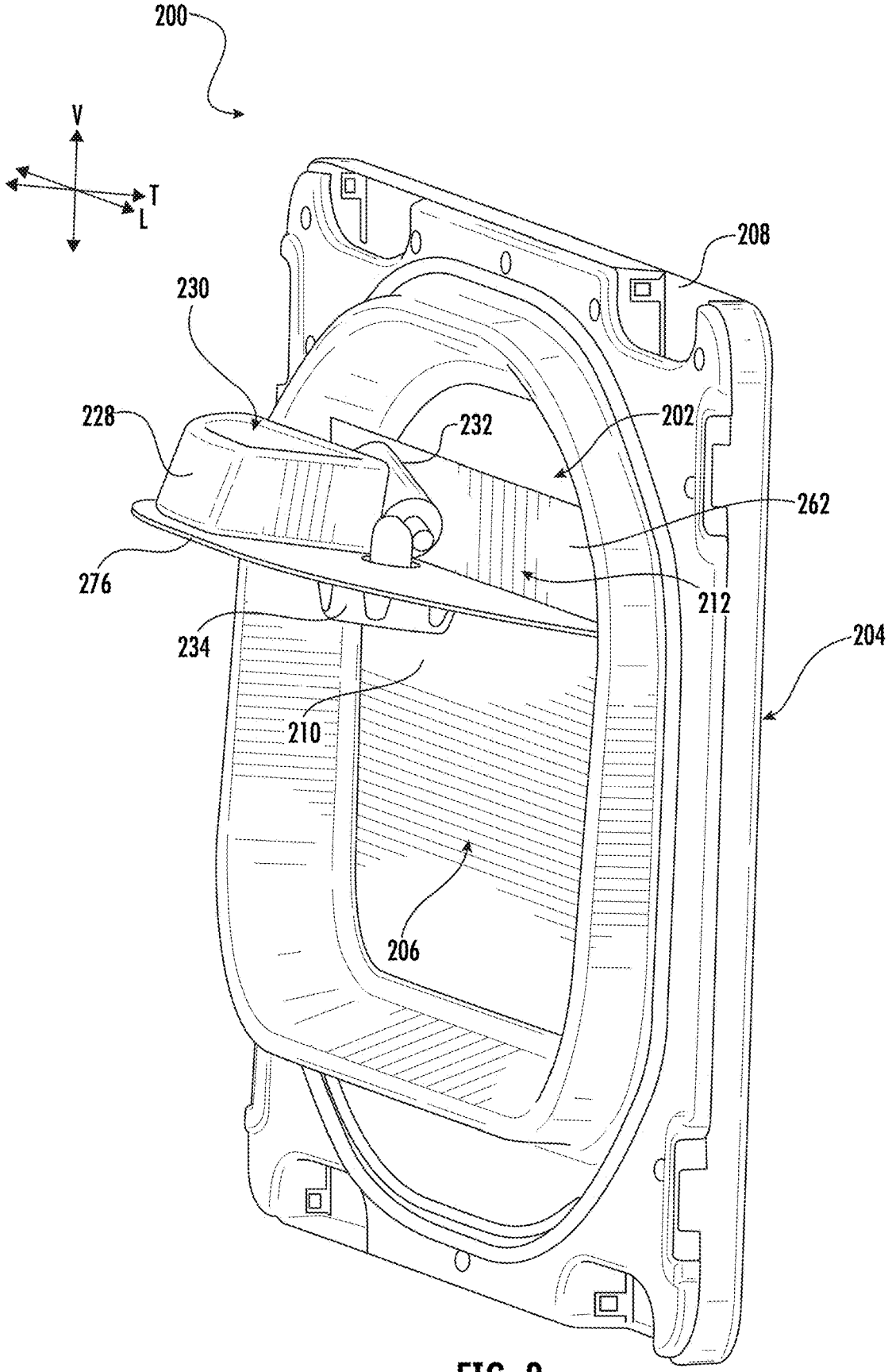
FIG. 8 provides a perspective of the exemplary door of FIG. 7 with various components removed to reveal certain portions of the door.
Figure 9:
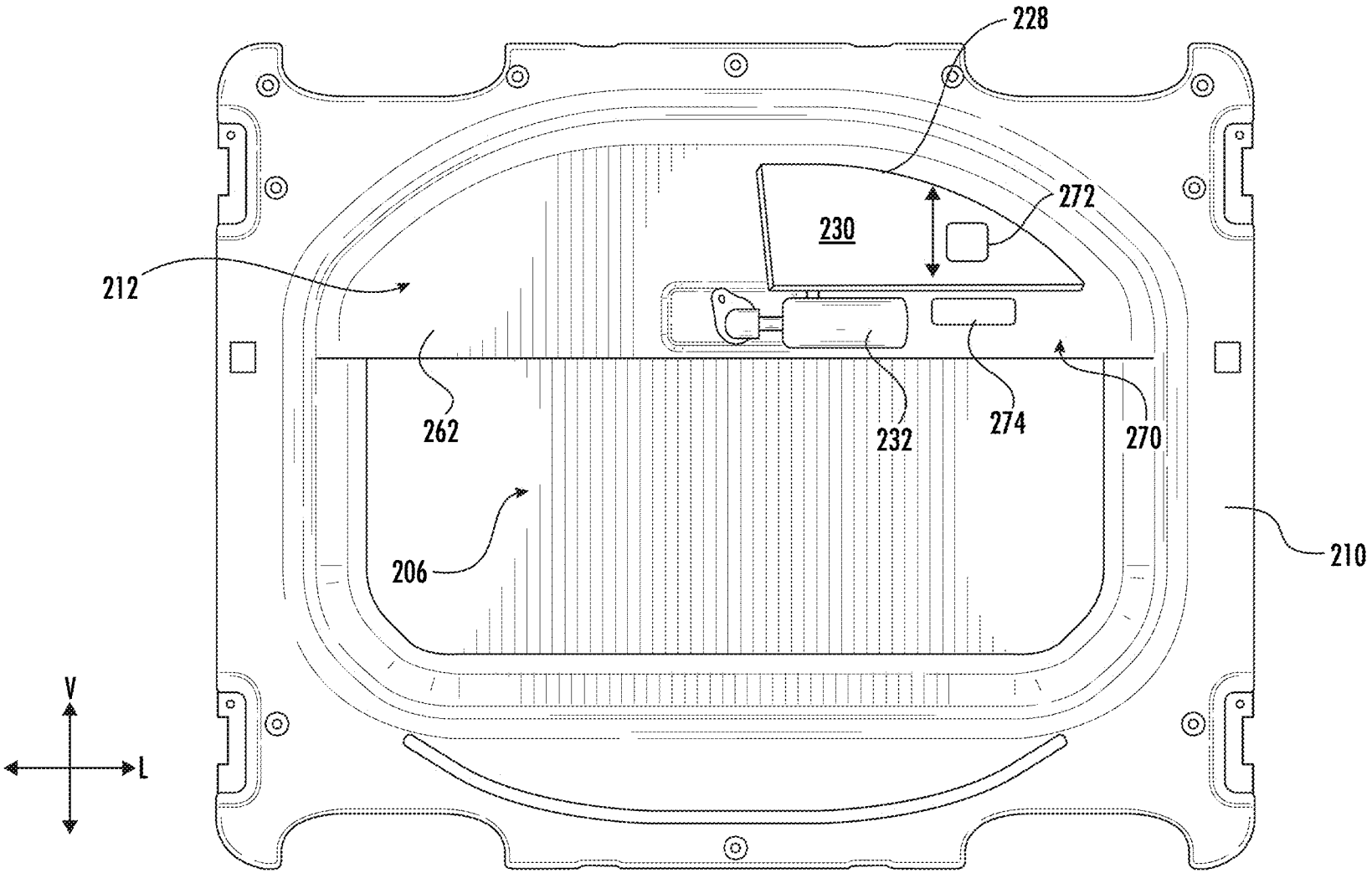
FIG. 9 provides a schematic front elevation view of the exemplary door of FIG. 7.
Figure 10:
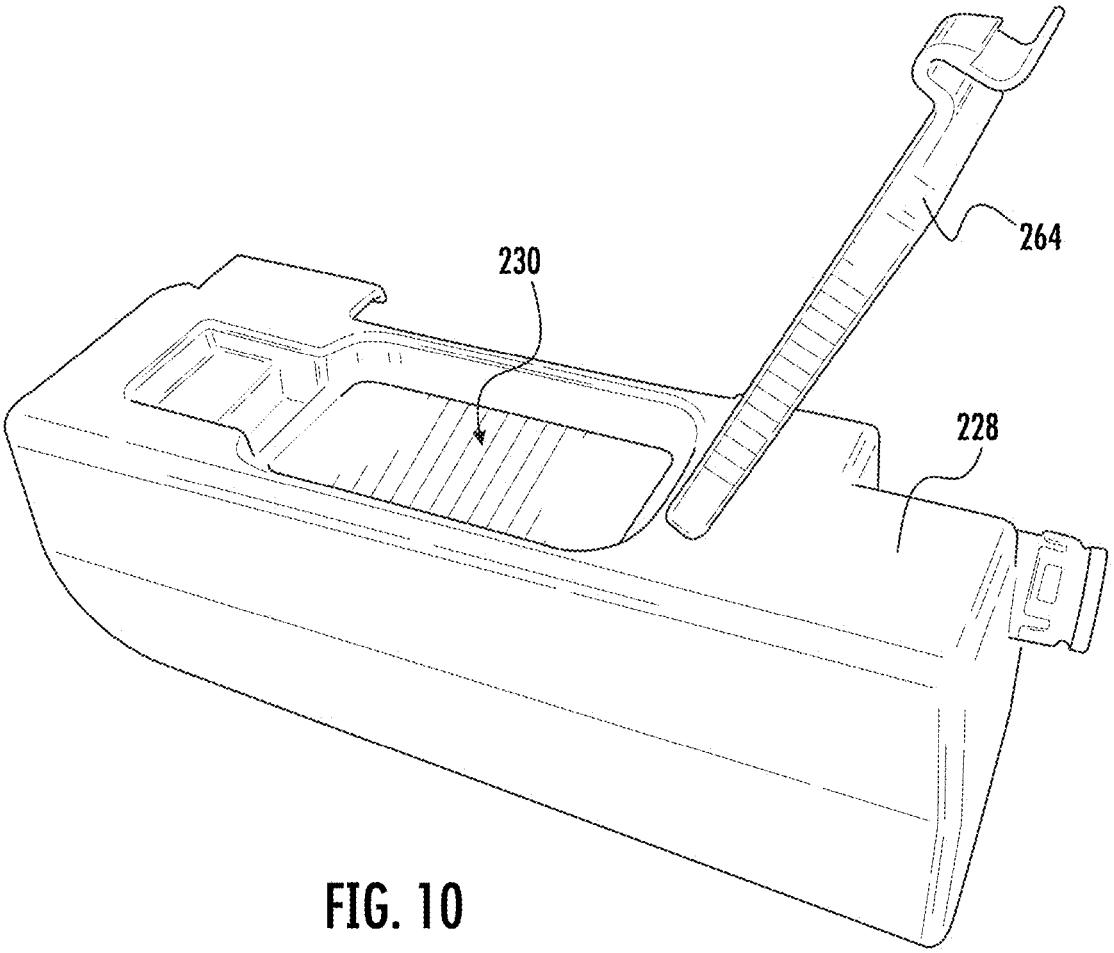
FIG. 10 provides a perspective view of an additive tank of an additive dispensing assembly according to exemplary embodiments of the present disclosure.

Referring now to FIGS. 7 through 10, a door 200 and additive dispensing assembly 202 are illustrated according to other exemplary embodiments of the present disclosure. Specifically, FIGS. 7 through 10 provide various views of a door 200 (e.g., provided as or as part of door 33) to a laundry appliance (e.g., dryer appliance 10). FIGS. 8 through 10 illustrate portions of an additive dispensing assembly 202. Although described separately from the embodiments of FIGS. 3 through 6, it is understood that the embodiments described herein are not mutually exclusive. Moreover, except as otherwise indicated, the embodiments of FIGS. 7 through 10 may include the features of FIGS. 3 through 6, and vice versa.

In certain embodiments, a partially enclosed (e.g., U-shaped) pocket 262 formed from one or more fence walls defines internal cavity 212. For instance, pocket 262 may be pivotably mounted to door 200 (e.g., at inner panel 210) to rotate or pivot between a covered position (FIG. 7) and an uncovered position (FIG. 8). An interior fence wall 276 of pocket 262 may define at least a portion of interior surface 206. As shown, in the covered position, interior fence wall 276 may be engaged with a portion of inner panel 210 (e.g., at a suitable latch or clasp) such that interior fence wall 276 is held upright relative to the vertical direction V and access to internal cavity 212 is restricted. In turn, a user may be unable to pass a hand or object through the open end of the U-shaped pocket 262 to internal cavity 212. By contrast, in the uncovered position, a top end of interior fence wall 276 is spaced apart from inner panel 210 (e.g., at an angle between 20° and 90° relative to the vertical direction V) such that access to the internal cavity 212 is permitted. In turn, a user may be able to pass a hand or object through the open end of the U-shaped pocket 262 when door 200 is in an open position (or otherwise not fully closed).

When assembled, at least a portion of additive dispensing assembly 202 (e.g., additive tank 228, fluid pump 232, or dispenser nozzle 234) may be mounted to pocket 262. Thus, such a portion may pivot with pocket 262 between the covered and uncovered positions.

For instance, one or more portions of additive dispensing assembly 202 (e.g., additive tank 228 or fluid pump 232) may be secured to pocket 262 via a plurality of mounting features or mechanical fasteners. Additionally or alternatively, adhesive(s), snap-fit mechanisms, interference-fit mechanisms, or any suitable combination thereof may secure one or more portions of additive dispensing assembly 202 to pocket 262. One skilled in the art will appreciate that additive dispensing assembly 202 may be mounted using other mounting means according to alternative embodiments. In optional embodiments, additive tank 228 in particular is removably mounted within internal cavity 212 (e.g., to pocket 262). Thus, a user may selectively remove additive tank 228 from door 200 in order to supply or refill the liquid or dryer additive within tank volume 230. A movable lid 264 may be provided on additive tank 228 to selectively block an opening to tank volume 230 such that removal of the lid 264 permits a user to access and refill tank volume 230, regardless of whether additive tank 228 is secured within internal cavity 212 or removed from internal cavity 212.

In some embodiments, a level sensor 270 is provided within or in communication with tank volume 230. In particular, level sensor 270 may be in wired or wireless communication with controller 56 or a dispenser-side circuit 282 and configured to detect if or when the amount of liquid or dryer additive within tank volume 230. As shown, level sensor 270 may include a magnetic element 272 (e.g., permanent magnet slug) movably disposed within tank volume 230. For instance, magnetic element 272 may be enclosed or supported within a floatable pod inside additive tank 228. Thus, the vertical position of magnetic element 272 within additive tank 228 (e.g., when internal cavity 212 is closed, such as when pocket 262 is in the covered position) may correspond (e.g., be correlated to and driven by) to the level of liquid or dryer additive. As the amount of liquid or dryer additive changes, the relative position of magnetic element 272 within tank volume 230 changes accordingly. A detection element 274 (e.g., reed switch) may be mounted or fixed at a predetermined position or level relative to additive tank 228 or tank volume 230. The predetermined level may correspond to a minimum level or volume of liquid or dryer additive within tank volume 230. Moreover, detection element 274 may be configured to detect (e.g., a magnetic field from) magnetic element 272. Thus, detection element 274 may detect a field or signal from magnetic element 272 in response to magnetic element 272 falling to the predetermined level.

Figure 11:
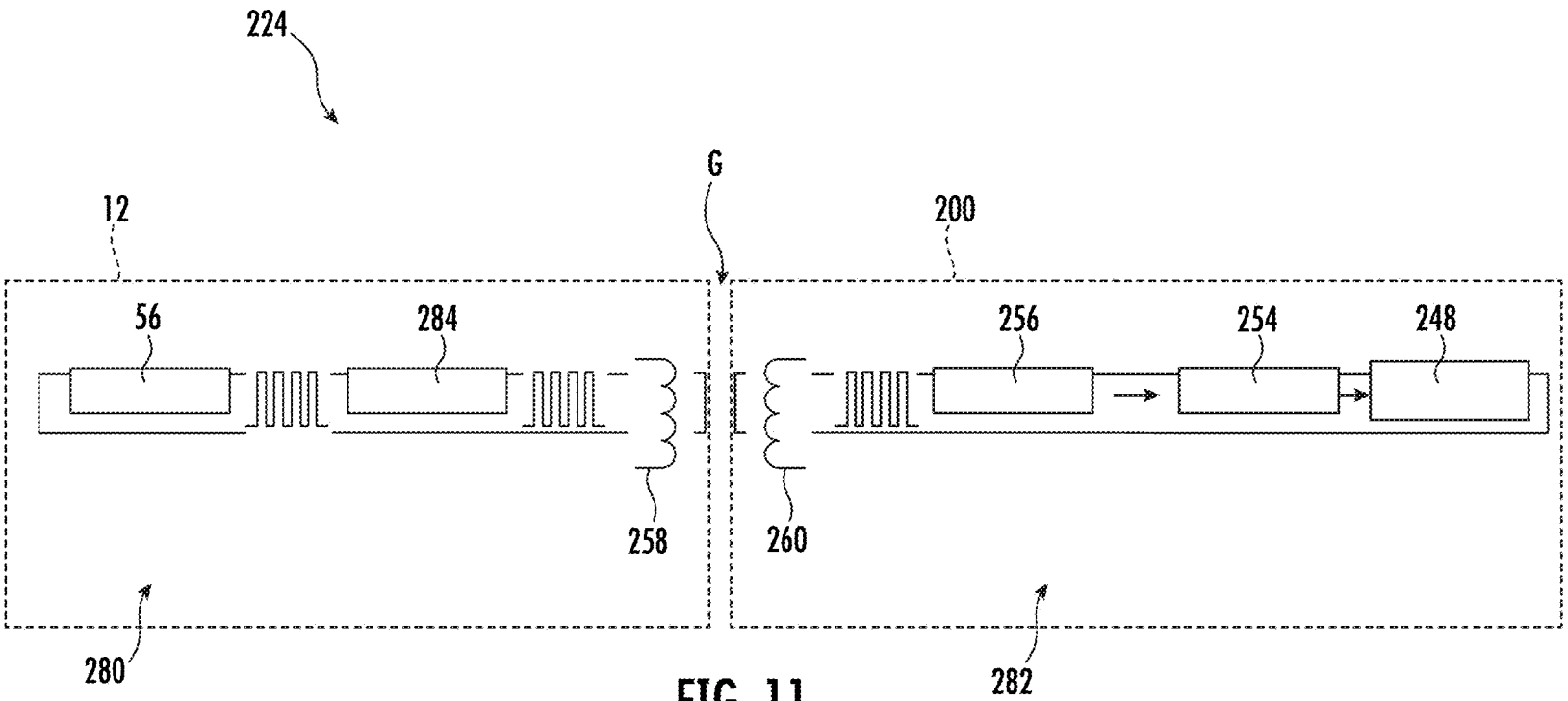
FIG. 11 provides a schematic view of an additive dispensing assembly according to exemplary embodiments of the present disclosure.

Returning now generally to FIGS. 1 through 6, as well as FIG. 11, at least a portion of additive dispensing assembly 202 may be physically and electrically separated from controller 56 (or another suitable power supply) on cabinet 12. Power may, instead, be conveyed wirelessly through wireless power assembly 224.

In some embodiments, wireless power assembly 224 includes a pair of separate power coils 258, 260. Specifically, a physically separated transmitter power coil 258 and receiver power coil 258 may be provided on discrete portions of appliance 10. When assembled, transmitter power coil 258 and receiver power coil 260 may thus be wirelessly coupled without ever coming into direct or electrical contact. In particular, an air gap G may be maintained between the two.

In exemplary embodiments, transmitter power coil 258 is mounted on cabinet 12, apart from door 200. For instance, transmitter power coil 258 may be mounted to cabinet 12 proximal to door 200 (e.g., when door 200 is in the closed position). In some such embodiments, transmitter power coil 258 is mounted to the front panel 14, as shown. Within cabinet 12, transmitter power coil 258 may be electrically coupled to controller 56 (e.g., via an amplifying circuit 284 as part of a supply-side circuit 280).

In additional or alternative embodiments, receiver power coil 260 is mounted to door 200. For instance, receiver power coil 260 may be mounted proximal to or within internal cavity 212. When assembled, receiver power coil 260 is in electrical communication with fluid pump 232.

In certain embodiments, wireless power assembly 224 includes one or more control circuits on door 200 that are electrically coupled to receiver power coil 260. As illustrated, for instance, in FIG. 11, a rectifying circuit 256 or activation circuit 254 may be mounted to door 200 in electrical communication with pump motor 248 to supply power thereto (e.g., as a dispenser-side circuit 282). Rectifying circuit 256, activation circuit 254, or pump motor 248 may be physically decoupled or isolated from controller 56 and, thus, share no physical connection with controller 56. Nonetheless, the dispenser-side circuit 282 (e.g., rectifying circuit 256, activation circuit 254, or pump motor 248) may be in wireless-power communication with a separate power supply or circuit on cabinet 12, such as a supply-side circuit 280 (e.g., including controller 56 or an amplifying circuit 284, which may be electrically coupled to controller 56).

Generally, transmitter power coil 258 and receiver power coil 260 may be configured to exchange an electromagnetic field that generates an electrical current. For instance, transmitter power coil 258 may transmit an electromagnetic field (e.g., as initiated by controller 56) that is received at receiver power coil 260. At receiver power coil 260, an electrical current or voltage may be generated and, subsequently transmitted through rectifying circuit 256 or activation circuit 254 to pump motor 248. For instance, the electromagnetic field may induce an electrical current at receiver power coil 260. Thus, the power coils 258, 260 may be a matched pair of resonant induction coils. Nonetheless, it is understood that any other suitable wireless power transmission method (e.g., inductive coupling, capacitive coupling, etc.) may be used.

In some embodiments, the power coils 258, 260 are configured such that the exchange of electromagnetic field is only permitted when door 200 is in the closed position. For instance, the distance or orientation of receiver power coil 260 relative to transmitter power coil 258 when door 200 is moved away from the closed position (e.g., in the open position) may prevent induction of a sufficient current or voltage at receiver power coil 260 to power pump motor 248. Thus, communication between transmitter power coil 258 and receiver power coil 260 is restricted in the open position of the door 200. Optionally, additive dispensing assembly 202 may be an electrically isolated assembly. In particular, dispenser-side circuit 282 may be electrically isolated such that no electrical power storage (e.g., electrical battery or ultracapacitor) is provided thereon. Thus, in the absence of wireless communication with supply-side circuit 280, additive dispensing assembly 202 may be free of a current or voltage therethrough, advantageously preventing unintended operation (e.g., when door 200 is in the open position).

In certain embodiments, controller 56 is configured to initiate a dispensing operation or otherwise control activation of additive dispensing assembly 202 (e.g., at pump 232). For instance, controller 56 may direct a signal or voltage to transmitter power coil 258 in order to generate the electromagnetic field therefrom. In some such embodiments, activation of pump motor 248 may be controlled entirely on the electrical current directed thereto. Thus, additive dispensing assembly 202 may be communicatively isolated from controller 56. Notably, a complex transmission of data signals from controller 56 to fluid pump 232 may be avoided.

In additional or alternative embodiments, an instructive signal pattern is delivered to additive dispensing assembly 202 from controller 56 through the power coils 258, 260. In other words, the controller 56 may be configured to control the dispensing operation according to the instructive signal pattern. In particular, the controller 56 may be configured to adjust the volume of liquid additive motivated from the fluid pump 232 according to an instructive signal pattern transmitted from the transmitter power coil 258 to the additive dispensing assembly 202 (e.g., at the receiver power coil 260).

For instance, prior to activation of pump motor 248 (e.g., facilitated by a continuous generation and transmission of an electromagnetic field to receiver power coil 260), controller 56 may direct transmitter power coil 258 to generate an electromagnetic field according to a discontinuous pattern (e.g., actively transmit the electromagnetic field for a set "ON period" then immediately halt electromagnetic field transmission for a set "OFF period"). The discontinuous pattern (i.e., instructive signal pattern) may subsequently be received at the receiver power coil 258, 260 and detected at one or more circuits (e.g., a sub-assembly control board) of additive dispensing assembly 202.

From the detected discontinuous pattern (e.g., sequence or frequency), the additive dispensing assembly 202 may determine the size or volume (e.g., relative volume, such as high or low) of additive fluid to dispense. As an example, a detected discontinuous pattern of 1 second "ON" followed by 1 second "OFF" may indicate a high volume of additive fluid to be delivered from additive dispensing assembly 202 while a detected discontinuous pattern of 1 second "ON" and 0.5 second "OFF" may indicate a low volume of additive fluid to be delivered from additive dispensing assembly 202. As another example, a detected discontinuous pattern having a frequency of 2 "ON" (e.g., power signals) per second may indicate a high volume of additive fluid to be delivered from additive dispensing assembly 202 while a detected discontinuous pattern having a frequency of 3 "ON" (e.g., power signals) per second may indicate a low volume of additive fluid to be delivered from additive dispensing assembly 202. Optionally, additive dispensing assembly 202 can communicate back its delivered volume (e.g., high or low), for example, by activating an electrical load (e.g., resister or LED on the sub-assembly control board) generally or in a specific frequency. The activated electrical load or frequency corresponds to the delivered volume. The current on the additive dispensing assembly 202 may then be monitored (e.g., on controller 56 by measuring the current powering transmitter power coil 260, such as at the start of a wash cycle) to detect the delivered volume. Using the detected delivered volume, controller 56 may calculate the volume of liquid additive left within tank volume 230 (e.g., without the need for a separate sensor).

Optionally, when door 200 is in the closed position, transmitter power coil 258 may initiate an electromagnetic field to be transmitted therefrom. The transmitted electromagnetic field may then be received by the receiver power coil 260 to generate a corresponding electrical current, which can activate pump motor 248.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a space for the receipt of clothes for drying;

a transmitter power coil mounted to the cabinet apart from the drum; and an additive dispensing assembly held apart from the transmitter power coil and configured to provide an additive mist to the drum, the additive dispensing assembly comprising a fluid pump to motivate a volume of a liquid additive therefrom for the additive mist, a receiver power coil in selective wireless communication with the transmitter power coil to receive an electromagnetic field therefrom, the receiver power coil being operably coupled to the fluid pump, and a dispenser nozzle directed toward the drum downstream from the fluid pump to guide the volume of the liquid additive into the space defined by the drum.

2. The dryer assembly of claim 1, further comprising:

a door movably mounted to the cabinet to selectively restrict access to the drum, wherein the cabinet comprises a front panel defining an opening selectively covered by the door, and wherein the transmitter power coil is mounted to the front panel.

3. The dryer assembly of claim 1, wherein an air gap is defined between the transmitter power coil and the receiver power coil at a closed position of the door.

4. The dryer assembly of claim 1, further comprising:

a controller mounted on the cabinet in electrical communication with the transmitter power coil, the controller being configured to initiate a dispensing operation comprising directing an electrical current to the transmitter power coil to power the additive dispensing assembly.

5. The dryer assembly of claim 4, wherein the controller is configured to adjust the volume of liquid additive motivated from the fluid pump according to an instructive signal pattern transmitted from the transmitter power coil to the additive dispensing assembly.

6. The dryer assembly of claim 1, wherein the additive dispensing assembly is an electrically isolated assembly.

7. The dryer assembly of claim 1, wherein wireless communication between the transmitter power coil and the receiver power coil is restricted in an open position of the door.

8. The dryer appliance of claim 1, wherein the liquid additive comprises a perfume, a UV fabric protector, a wrinkle release fluid, or a medicinal liquid.

9. The dryer appliance of claim 1, wherein the fluid pump comprises a fluid cylinder and a reciprocating piston slidably disposed within the fluid cylinder.

10. The dryer appliance of claim 1, wherein the additive dispensing assembly further comprises a one-way valve mounted in fluid communication between the fluid pump and the dispenser nozzle.

11. A laundry appliance comprising:

a cabinet;

a drum rotatably mounted within the cabinet, the drum defining a space for the receipt of clothes;

a door movably mounted to the cabinet to selectively restrict access to the drum;

a transmitter power coil mounted to the cabinet proximal to the door; and an additive dispensing assembly held on the door, the additive dispensing assembly being electrically isolated and configured to provide an additive mist to the drum, the additive dispensing assembly comprising a fluid pump to motivate a volume of a liquid additive therefrom for the additive mist, a receiver power coil in selective wireless communication with the transmitter power coil to receive an electromagnetic field therefrom, the receiver power coil being operably coupled to the fluid pump, and a dispenser nozzle directed toward the drum downstream from the fluid pump to guide the volume of the liquid additive into the space defined by the drum.

12. The laundry appliance of claim 11, further comprising:

a door movably mounted to the cabinet to selectively restrict access to the drum, wherein the cabinet comprises a front panel defining an opening selectively covered by the door, and wherein the transmitter power coil is mounted to the front panel.

13. The laundry appliance of claim 11, wherein an air gap is defined between the transmitter power coil and the receiver power coil at a closed position of the door.

14. The laundry appliance of claim 11, further comprising:

a controller mounted on the cabinet in electrical communication with the transmitter power coil, the controller being configured to initiate a dispensing operation comprising directing an electrical current to the transmitter power coil to power the additive dispensing assembly.

15. The dryer assembly of claim 14, wherein the controller is configured to adjust the volume of liquid additive motivated from the fluid pump according to an instructive signal pattern transmitted from the transmitter power coil to the additive dispensing assembly.

16. The laundry appliance of claim 14, wherein the additive dispensing assembly is communicatively isolated from the controller.

17. The laundry appliance of claim 11, wherein wireless communication between the transmitter power coil and the receiver power coil is restricted in an open position of the door.

18. The laundry appliance of claim 11, wherein the liquid additive comprises a perfume, a UV fabric protector, a wrinkle release fluid, or a medicinal liquid.

19. The laundry appliance of claim 11, wherein the fluid pump comprises a fluid cylinder and a reciprocating piston slidably disposed within the fluid cylinder.

20. The laundry appliance of claim 11, wherein the additive dispensing assembly further comprises a one-way valve mounted in fluid communication between the fluid pump and the dispenser nozzle.

* * * * *